US008322270B2

(12) United States Patent
Hinrichs

(10) Patent No.: US 8,322,270 B2
(45) Date of Patent: Dec. 4, 2012

(54) RECIPROCATING PISTON MACHINE

(75) Inventor: Jan Hinrichs, Friedrichsdorf (DE)

(73) Assignee: LUK Fahrzeug-Hydraulik GmbH & Co. KG, Bad Homburg (DE)

( * ) Notice: Subject to any disclaimer, the term of this patent is extended or adjusted under 35 U.S.C. 154(b) by 337 days.

(21) Appl. No.: 11/666,776

(22) PCT Filed: Oct. 20, 2005

(86) PCT No.: PCT/DE2005/001869

§ 371 (c)(1),
(2), (4) Date: May 1, 2007

(87) PCT Pub. No.: WO2006/047985

PCT Pub. Date: May 11, 2006

(65) Prior Publication Data

US 2008/0223210 A1 Sep. 18, 2008

(30) Foreign Application Priority Data

Nov. 5, 2004 (DE) ..... 10 2004 053 483

(51) Int. Cl.
*F01B 3/00* (2006.01)

(52) U.S. Cl. ..... 92/71; 92/147

(58) Field of Classification Search ..... 92/147, 92/71; 384/452–455

See application file for complete search history.

(56) References Cited

U.S. PATENT DOCUMENTS

| | | | | |
|---|---|---|---|---|
| 2,852,320 | A * | 9/1958 | Cornelius | 384/455 |
| 2,929,551 | A | 3/1960 | Heidorn | |
| 3,018,145 | A * | 1/1962 | Cornelius | 384/455 |
| 3,424,507 | A * | 1/1969 | Rollinset al. | 384/454 |
| 3,552,886 | A | 1/1971 | Olson | |
| 3,746,475 | A * | 7/1973 | Johnson | 417/269 |
| 4,347,046 | A * | 8/1982 | Brucken et al. | 92/79 |
| 4,444,549 | A | 4/1984 | Takahashi et al. | |
| 4,784,045 | A * | 11/1988 | Terauchi | 92/71 |
| 7,063,464 | B2 | 6/2006 | Weber et al. | |

FOREIGN PATENT DOCUMENTS

| | | |
|---|---|---|
| DE | 42 11 695 A1 | 10/1992 |
| DE | 102 03 073 A1 | 9/2002 |

* cited by examiner

*Primary Examiner* — F. Daniel Lopez
(74) *Attorney, Agent, or Firm* — Davidson, Davidson & Kappel, LLC

(57) ABSTRACT

A reciprocating piston machine, such as an air-conditioning compressor for motor vehicles, having a housing, a rotationally drivable shaft, a shaft sealing device, in particular a mechanical shaft seal, at least one radial shaft bearing, especially a radial rolling-contact bearing, and at least one axial shaft bearing, in particular an axial rolling-contact bearing, a bearing sleeve which accommodates at least the radial shaft bearing, being configured within an opening in the housing, extending into the same.

18 Claims, 3 Drawing Sheets

1
5
21

5
13
21
1
21
7

RECIPROCATING PISTON MACHINE

The present invention relates to a reciprocating piston machine, such as an air-conditioning compressor for motor vehicles, having a housing, a rotationally drivable shaft, a shaft sealing device, in particular a mechanical shaft seal, having at least one radial shaft bearing, in particular a radial rolling-contact bearing, having at least one axial shaft bearing, in particular an axial rolling-contact bearing, a bearing sleeve, which accommodates at least the radial shaft bearing, being configured within an opening in the housing, extending into the same.

BACKGROUND

Reciprocating piston machines of this kind are generally known.

In this context, the bearing sleeve and the housing are joined to one another by a weld seam, for example, the weld seam being placed in a region that is subject to highly fluctuating loads and, in the event of failure of the weld seam, there being the risk of parts of the housing loosening.

SUMMARY OF THE INVENTION

It is, therefore, an object of the present invention to devise a reciprocating piston machine which will overcome these disadvantages.

The present invention provides a reciprocating piston machine, such as an air-conditioning compressor for motor vehicles, having a housing, a rotationally drivable shaft, a shaft sealing device, in particular a mechanical shaft seal, having at least one radial shaft bearing, in particular a radial rolling-contact bearing, having at least one axial shaft bearing, in particular an axial rolling-contact bearing, a bearing sleeve, which accommodates at least the radial shaft bearing, being configured within an opening in the housing, extending into the same, the bearing sleeve having a first collar, which, viewed from the housing side, outwardly from the inside, comes to rest within the housing in the axial direction, against an annular contact surface in a recess within the housing, so that axial forces acting on the bearing sleeve outwardly from the inside when viewed from the housing side, are able to be absorbed by the housing (introduced into the housing) by the action of positive engagement.

A reciprocating piston machine is preferred, where a second smaller-diameter collar, which extends through an opening of the housing, is configured axially upstream of the first contact collar, when viewed from the housing side, outwardly from the inside. In addition, a reciprocating piston machine is preferred where the first collar, together with the second collar, constitute one common stepped collar, which extends through the opening of the housing, engaging positively therewith in the radial and axial directions.

The present invention also provides that the radially outer region of the second collar, together with the radially inner region of the opening of the housing, form a common region for introducing a weld seam. Here the advantage is derived that, particularly with regard to axial forces produced by the axial shaft bearing, the weld seam is located in the area that is subject to less load since the axial forces may be introduced into the housing by way of the first collar. Even in the event of failure of the weld seam, the bearing sleeve would be held securely by the axial forces within the housing, in positive engagement therewith.

In addition, a reciprocating piston machine is preferred where, at one axial end face within the housing, the bearing sleeve accommodates the axial shaft bearing. A reciprocating piston machine is also preferred where the bearing sleeve accommodates the radial shaft bearing within a radial recess. A reciprocating piston machine is also preferred where the bearing sleeve accommodates a mechanical shaft seal within an additional radial recess. The present invention also provides that between the regions where the mechanical shaft seal and the radial shaft bearing are located, the bearing sleeve has lubricant passage bores for the mechanical shaft seal and the radial shaft bearing. A reciprocating piston machine is also preferred where, radially outwardly within the housing, the bearing sleeve has a groove which functions as a lubricant-collecting groove and contains the lubricant passage bores.

The present invention furtherprovides that the bearing sleeve is provided outside of the housing with a region for accommodating a rolling-contact bearing of a belt pulley.

Overall, therefore, by using a bearing sleeve of this kind in combination with an air-conditioning compressor housing, the advantage is derived that a small bearing sleeve component is easier to clamp and machine than a large housing, and that the seat of the inner bearing and the seat of the outer bearing may be machined in one clamping operation, thereby permitting narrower tolerances and a more efficient operation of the machine.

BRIEF DESCRIPTION OF THE DRAWINGS

The present invention is described with reference to the figures, which show.

DETAILED DESCRIPTION

Figure 1:
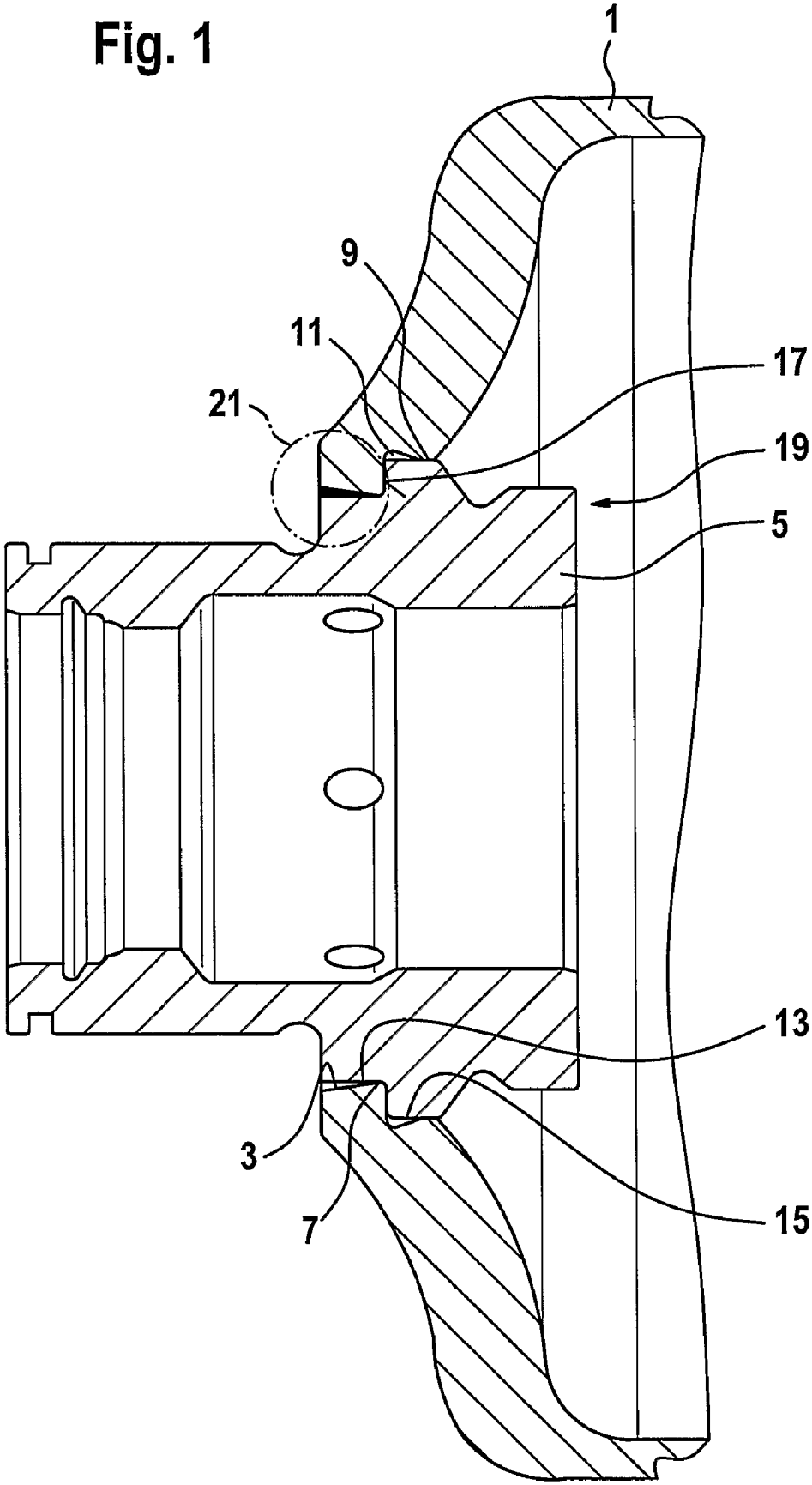
FIG. 1 a bearing sleeve according to the present invention in cross section in one part of the housing.

A bearing sleeve 5 is inserted in an opening 3 in a housing section 1 of an air-conditioning compressor. Opening 3 has a smaller-diameter part 7 and a larger-diameter part 9, so that, for all intents and purposes, opening 3 is a stepped, annular opening. In region 11, larger-diameter part 9 of the stepped bore of the housing is enlarged to a somewhat greater degree by a radially outwardly extending undercut. By way of a smaller-diameter collar 13 and a larger-diameter collar 15, bearing sleeve 5 engages in this stepped recess 3 of housing 1, thereby producing an axial contact surface 17 between bearing sleeve 5 and housing part 1. Since axial forces act on bearing sleeve 5 in the direction of arrow 19 via an axial shaft bearing from the power unit of the compressor, bearing sleeve 5 is pressed at contact surface 17 against housing 1 in positive engagement therewith. Thus, the axial forces are introduced from the compressor power unit into housing 1 via contact surface 17. As a result, smaller-diameter collar 7 of the housing, respectively smaller-diameter collar 13 of bearing sleeve 5 are disposed in a region where axial forces no longer act. Thus, as the area that is subject to less load, this region 21 between housing collar 7 and bearing sleeve collar 13 is suited in accordance with the present invention for producing a weld seam for joining bearing sleeve 5 to housing 1. Even if the weld seam in this region 21 were to become defective under certain circumstances, then the axial forces of the power unit acting in arrow direction 19 would ensure that bearing sleeve 5 is pressed by the axial forces against housing 1 in positive engagement therewith, and thus that the function is maintained between bearing sleeve 5 and housing 1.

Figure 2:
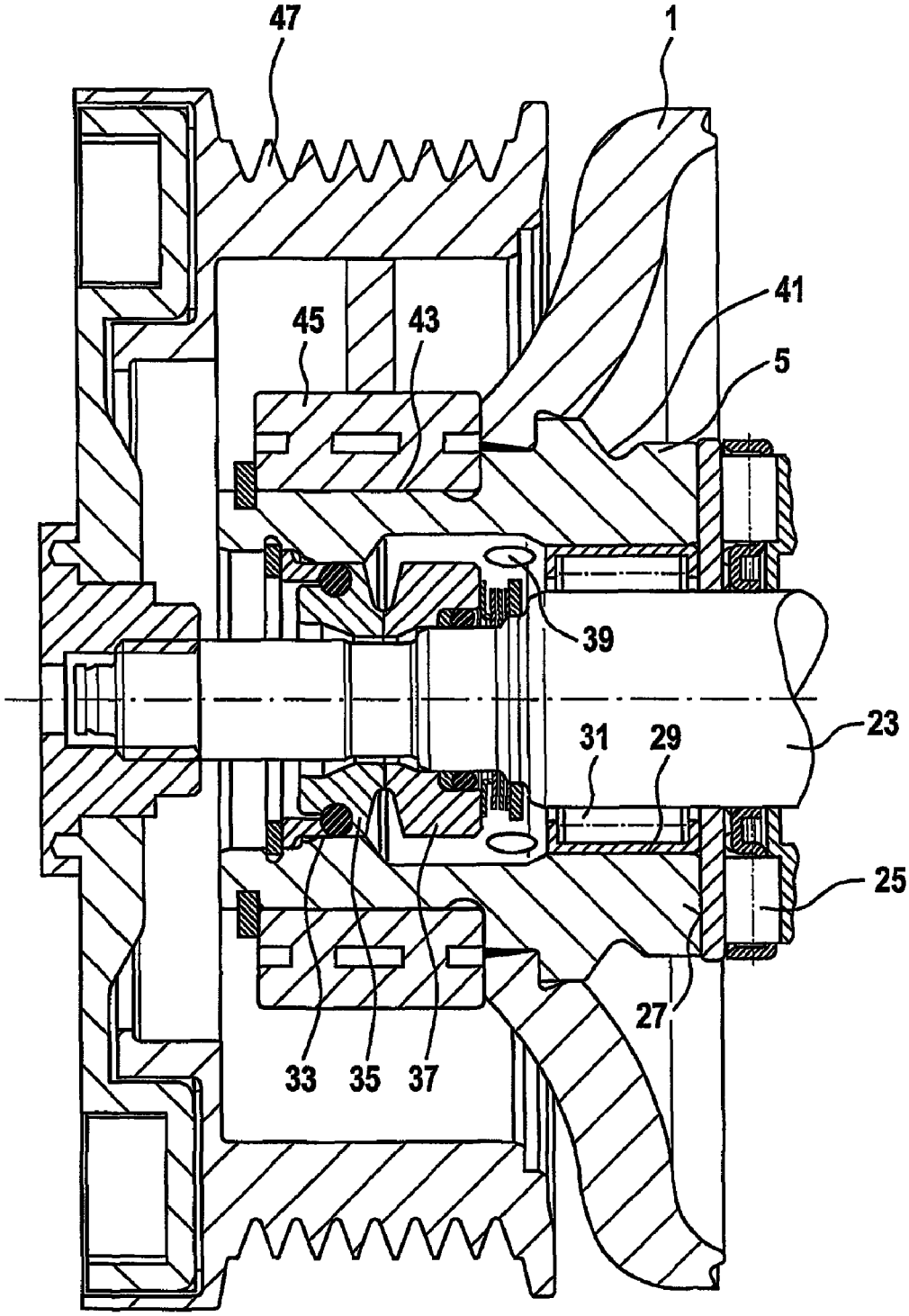
FIG. 2 a sectional view of a compressor in the area of the bearing sleeve according to the present invention.

FIG. 2 shows a cross section through the corresponding part of the air-conditioning compressor having housing part 1 and bearing sleeve 5. Extending completely through bearing sleeve 5 is a drive shaft 23, which is supported by an axial shaft bearing 25 on an axial end face 27 of bearing sleeve 5. In addition, shaft 23 is supported by a radial rolling-contact bearing 31 in region 29 of bearing sleeve 5. A mechanical shaft seal having a fixed part 35 and a rotating part 37 are located in a front region 33 of bearing sleeve 5. Lubricant passage bores 39, which lead from the interior space of sleeve 5 outwardly into a circumferential groove 41 that wraps around sleeve 5, are disposed between region 29 of the radial rolling-contact bearing and region 33 of the mechanical shaft seal. In this context, groove 41 in the drive chamber of the compressor functions as a lubricant-collecting groove. It directs lubricant via passage bores 39 into the region of the bearing sleeve between mechanical shaft seal 35/37 and radial rolling-contact bearing 31. Thus, both mechanical shaft seal 35/37, as well as radial rolling-contact bearing 31 are supplied with lubricant within bearing sleeve 5. A rolling-contact bearing 45, which supports belt pulley 47, is arranged on outer surface 43 of bearing sleeve 5 outside of housing 1. Thus, when manufacturing bearing sleeve 5, both the bearing surfaces for radial rolling-contact bearing 31, as well as radial rolling-contact bearing 45 may be fabricated in one clamping operation, thereby permitting a more favorable machining process in terms of tolerances. In this context, by dividing the compressor housing into one large housing part 1 and one smaller bearing sleeve part 5, it is ensured that a small component may be used for machining the bearing seats that is easier to clamp and to machine than a large one-piece housing which, otherwise, would have to have these corresponding bearing seats.

Figures 3A, 3B:
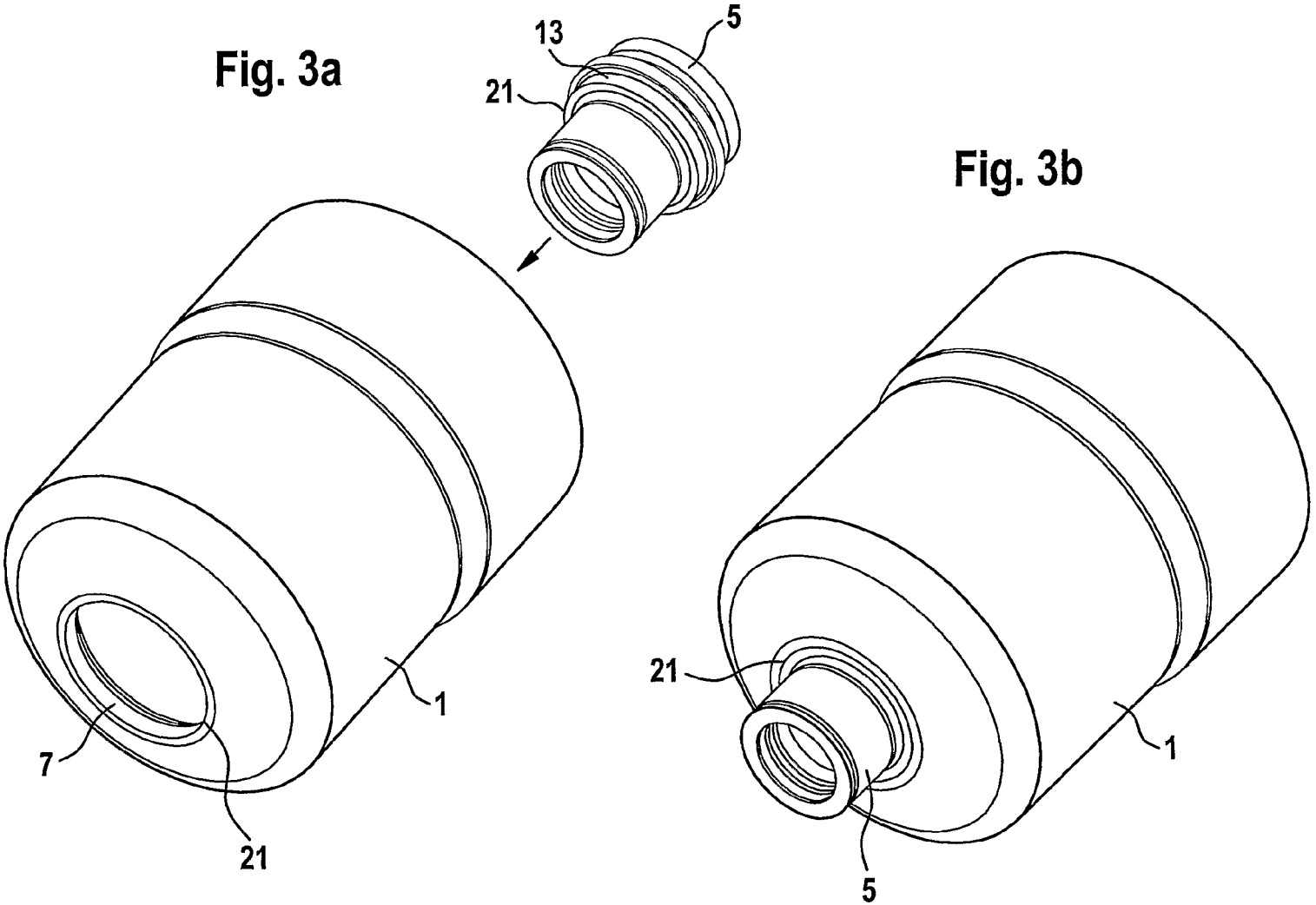
FIGS. 3*a* and 3*b* in a perspective representation, a bearing sleeve according to the present invention and the corresponding housing.

In FIG. 3*a*, bearing sleeve 5 and complete housing component 1 are shown separately and, in FIG. 3*b*, in the assembled state. The corresponding weld seam is applied in region 21 between housing 1 and bearing sleeve 5, in this region, it being preferable to apply a laser weld which may be produced on a very narrow region having a great depth, as is discernible in the cross section of FIG. 1, in region 21.

Thus, a cost reduction is achieved by the inventive approach for designing bearing sleeve 5 and housing part 1, due to the improved machinability of sleeve 5, as is an enhanced component reliability, due to proper positioning of the stepped collar and the weld seam. Even in the event of failure of the weld seam, a secure form-locking connection is ensured by the positive engagement between sleeve 5 and housing 1 in the direction of axial forces 19.

LIST OF REFERENCE NUMERALS

1 air-conditioning compressor housing
3 opening in the housing
5 bearing sleeve
7 smaller-diameter part of the opening
9 larger-diameter part of the opening
11 undercut region of the stepped bore
13 smaller-diameter collar of the bearing sleeve
15 larger-diameter collar of the bearing sleeve
17 axial contact surface of the bearing sleeve
19 direction of the axial forces
21 area subject to less load by axial forces (weld seam area)
23 drive shaft
25 axial shaft bearing
27 axial end face of the bearing sleeve
29 region for the radial rolling-contact bearing
31 radial rolling-contact bearing
33 region of the bearing sleeve for the mechanical shaft seal
35 fixed part of the mechanical shaft seal
37 rotating part of the mechanical shaft seal
39 lubricant passage bores
41 circumferential lubricant-collecting groove
43 outer surface of the bearing sleeve outside of the housing
45 rolling-contact bearing for the belt pulley
47 belt pulley

What is claimed is:

1. A reciprocating piston machine comprising:

a housing having an opening, a recess in the opening having an annular contact surface between a small diameter part of an interior of the housing and a larger diameter part of the interior of the housing, and an inside, the smaller diameter part and the larger diameter part being formed from a single piece of the housing;

an axial shaft bearing;

a radial shaft bearing;

a rotationally drivable shaft, the drivable shaft being supported by the radial shaft bearing and the axial shaft bearing;

a shaft sealing device; and a bearing sleeve accommodating the radial shaft bearing and the shaft sealing device, the bearing sleeve being configured within the opening in the housing such that a first axial portion extends into the inside of the housing and a second axial portion extends outside of the housing, the shaft sealing device contacting an inner surface of the second axial portion, the bearing sleeve including a first collar having a first collar surface between a first collar smaller diameter surface and a first collar larger diameter surface, the first collar surface resting within the housing in an axial direction on the annular contact surface in the recess so that axial forces acting on the bearing sleeve outwardly from the inside are absorbed by the housing by action of positive engagement between the first collar surface of the bearing sleeve and the annular surface of the recess of the housing;

wherein a portion of the first collar smaller diameter surface is angled away from the smaller diameter part of the housing.

2. The reciprocating piston machine as recited in claim 1 wherein the shaft sealing device includes a mechanical shaft seal.

3. The reciprocating piston machine as recited in claim 1 wherein the radial shaft bearing is a rolling-contact bearing.

4. The reciprocating piston machine as recited in claim 1 wherein the axial shaft bearing is a rolling-contact bearing.

5. The reciprocating piston machine as recited in claim 1 wherein the first collar smaller diameter surface, together with the first collar larger diameter surface, define one common stepped collar, extending through the opening of the housing, engaging positively with the opening in the radial and axial directions.

6. The reciprocating piston machine as recited in claim 1 wherein a radially outer region of the first collar smaller diameter surface, together with a radially inner region of the opening of the housing, form a common region at which the radially outer region of the first collar smaller diameter surface and radially inner region of the opening of the housing are joined by a weld seam.

7. The reciprocating piston machine as recited claim 1 wherein the bearing sleeve accommodates the axial shaft bearing at one axial end face within the housing.

8. The reciprocating piston machine as recited in claim 1 wherein the bearing sleeve accommodates the radial shaft bearing within a radial recess.

9. The reciprocating piston machine as recited in claim 2 wherein between regions where the radial shaft bearing and the mechanical shaft seal are located, the bearing sleeve has lubricant passage bores for the mechanical shaft seal and the radial shaft bearing.

10. The reciprocating piton machine as recited in claim 9 wherein the bearing sleeve has a lubricant-collecting groove extending circumferentially on an outer surface of the bearing sleeve within the housing, the lubricant passage bores leading from an interior space of the bearing sleeve outwardly into the lubricant-collecting groove.

11. The reciprocating piston machine as recited in claim 1 wherein the second axial portion of the bearing sleeve accommodates a rolling-contact bearing of a belt pulley.

12. The reciprocating piston machine as recited in claim 1 wherein the reciprocating piston machine is an air-conditioning compressor for a motor vehicle.

13. A reciprocating piston machine comprising:

a housing having an opening, a recess in the opening having an annular contact surface between a small diameter part of an interior of the housing and a larger diameter part of the interior of the housing, and an inside, the smaller diameter part and the larger diameter part being formed from a single piece of the housing;

an axial shaft bearing;

a radial shaft bearing;

a rotationally drivable shaft, the drive shaft being supported by the radial shaft bearing and the axial shaft bearing;

a shaft sealing device; and a bearing sleeve accommodating the radial shaft bearing and the shaft sealing device, the bearing sleeve being configured within the opening in the housing, extending into the inside of the housing, the bearing sleeve having a first collar surface between a first collar smaller diameter surface and a first collar larger diameter surface, the first collar smaller diameter surface resting within the housing in an axial direction, on the annular contact surface in the recess so that axial forces acting on the bearing sleeve outwardly from the inside are absorbed by the housing by action of positive engagement between the first collar surface of the bearing sleeve and the annular surface of the recess of the housing;

wherein the first collar smaller diameter surface is joined with the smaller diameter part of the housing by a weld seam.

14. The reciprocating piston machine as recited in claim 1 wherein the larger diameter part of the interior of the housing includes a region that is enlarged to a greater degree by a radially outwardly extending undercut, the first collar larger diameter surface of the bearing sleeve being adjacent to the undercut.

15. The reciprocating piston machine as recited in claim 6 wherein the weld seam is disposed in an area that is subjected to less axial forces from the inside of the housing than outer portions of the first collar.

16. The reciprocating piston machine as recited in claim 1 wherein the portion of the first collar smaller diameter surface that is angled away from the smaller diameter part of the housing is joined with the smaller diameter part of the housing by a weld seam.

17. A reciprocating piston machine comprising:

a housing having an opening, a recess in the opening having an annular contact surface between a small diameter part of an interior of the housing and a larger diameter part of the interior of the housing, and an inside, the smaller diameter part and the larger diameter part being formed from a single piece of the housing;

an axial shaft bearing;

a radial shaft bearing;

a rotationally drivable shaft, the drivable shaft being supported by the radial shaft bearing and the axial shaft bearing;

a shaft sealing device; and a bearing sleeve accommodating the radial shaft bearing and the shaft sealing device, the bearing sleeve being configured within the opening in the housing such that a first axial portion extends into the inside of the housing and a second axial portion extends outside of the housing, the shaft sealing device contacting an inner surface of the second axial portion, the bearing sleeve including a first collar having a first collar surface between a first collar smaller diameter surface and a first collar larger diameter surface, and the first collar surface resting within the housing in an axial direction on the annular contact surface in the recess so that axial forces acting on the bearing sleeve outwardly from the inside are absorbed by the housing by action of positive engagement between the first collar surface of the bearing sleeve and the annular surface of the recess of the housing;

wherein the larger diameter part of the interior of the housing includes a region that is enlarged to a greater degree by a radially outwardly extending undercut, the first collar larger diameter surface of the bearing sleeve being adjacent to the undercut.

18. A reciprocating piston machine comprising:

a housing having an opening, a recess in the opening having an annular contact surface between a small diameter part of an interior of the housing and a larger diameter part of the interior of the housing, and an inside, the smaller diameter part and the larger diameter part being formed from a single piece of the housing;

an axial shaft bearing;

a radial shaft bearing;

a rotationally drivable shaft, the drivable shaft being supported by the radial shaft bearing and the axial shaft bearing;

a shaft sealing device; and a bearing sleeve accommodating the radial shaft bearing and the shaft sealing device, the bearing sleeve being configured within the opening in the housing such that a first axial portion extends into the inside of the housing and a second axial portion extends outside of the housing, the shaft sealing device contacting an inner surface of the second axial portion, the bearing sleeve including a first collar having a first collar surface between a first collar smaller diameter surface and a first collar larger diameter surface, and the first collar surface resting within the housing in an axial direction on the annular contact surface in the recess so that axial forces acting on the bearing sleeve outwardly from the inside are absorbed by the housing by action of positive engagement between the first collar surface of the bearing sleeve and the annular surface of the recess of the housing;

wherein a radially outer region of the first collar smaller diameter surface, together with a radially inner region of the opening of the housing, form a common region at which the radially outer region of the first collar smaller diameter surface and radially inner region of the opening of the housing are joined by a weld seam.

* * * * *